US007935657B2

(12) United States Patent
Jung

(10) Patent No.: US 7,935,657 B2
(45) Date of Patent: May 3, 2011

(54) RECORDING MEDIUM FOR THERMAL TRANSFER PRINTERS

(75) Inventor: Taek-yong Jung, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 1131 days.

(21) Appl. No.: 11/639,251

(22) Filed: Dec. 15, 2006

(65) Prior Publication Data

US 2008/0026940 A1 Jan. 31, 2008

(30) Foreign Application Priority Data

Jul. 31, 2006 (KR) ..... 10-2006-0072249

(51) Int. Cl.
*B41M 5/035* (2006.01)
*B41M 5/50* (2006.01)

(52) U.S. Cl. ..... 503/227; 428/32.39

(58) Field of Classification Search ..... None
See application file for complete search history.

(56) References Cited

U.S. PATENT DOCUMENTS

| | | | |
|---|---|---|---|
| 6,652,931 | B1 | 11/2003 | Otani et al. |
| 2003/0162660 | A1 | 8/2003 | Sakamoto et al. |

FOREIGN PATENT DOCUMENTS

| | | |
|---|---|---|
| EP | 0 466 336 | 1/1992 |
| JP | 11-208103 | 8/1999 |
| JP | 2004-209684 | 7/2004 |
| JP | 2005-132121 | 5/2005 |

*Primary Examiner* — Bruce H Hess

(74) *Attorney, Agent, or Firm* — Roylance, Abrams, Berdo & Goodman, L.L.P.

(57) ABSTRACT

A recording medium for thermal transfer printers includes: a base layer; a dye accepting layer applied to a surface of the base layer; and an inorganic material aid layer which is interposed between the base layer and the dye accepting layer. The inorganic material and layer contains an organic binder resin, an inorganic material having a particle diameter of 10 μm or greater and a brightening agent. The recording medium has the inorganic material aid layer interposed between the base and the dye accepting layer, which facilitates transfer of a recording ribbon dye. As a result, stain and wrinkle free and clear image quality can be obtained and light resistance can also be improved.

14 Claims, 1 Drawing Sheet

RECORDING MEDIUM FOR THERMAL TRANSFER PRINTERS

CROSS-REFERENCE TO RELATED PATENT APPLICATION

This application claims the benefit of Korean Patent Application No. 10-2006-0072249, filed on Jul. 31, 2006, in the Korean Intellectual Property Office, the disclosure of which is hereby incorporated by reference in its entirety.

BACKGROUND OF THE INVENTION

1. Field of the Invention

The present invention relates to a recording medium for thermal transfer printers. More particularly, the invention relates to the preparation of a recording medium having clear image quality and good preservation.

2. Description of the Related Art

A thermal transfer method has been widely used in office automation (OA) apparatuses such as facsimiles or printers. Recently, this method is applied even to the preparation of identification cards and the printing of electrical images from cameras, and thus, is an important means of photo printers together with methods for inkjet printing.

The thermal transfer method may be roughly divided into a sublimation type and a melt type. In the sublimation type, a transfer layer of recording medium consists of a thermal sublimation dye and a binder resin. Dye is delivered to a card or an accepting paper in proportion to thermal energy applied by a thermal element to form an image. This method is also referred to as a dye diffusion type. Since the amount of dye transferred is controlled in proportion to the applied thermal energy, continuous density gradation can be easily achieved on the transferred image. Color films having yellow, magenta, cyan colors, and the like belong to this class.

In the melt type, a transfer layer of recording medium has a thermal melting property. Heat applied by a thermal element to the transfer layer melts and transfers the transfer layer to a card or an accepting paper and then is solidified again. In the melt type, the entire resin of a coating layer is transferred to the card or accepting paper. Black or image protecting films belong to this class.

To obtain photographs or color images, there is a need for a thermal transfer recording ribbon which provides color and a recording medium which realizes color. The thermal transfer recording ribbon is prepared as described above. For the recording medium, plastic cards made of polyvinyl chloride and the like, and films or synthetic papers made of polyethyleneterephthalate, polyethylene, polypropylene, polyester, and the like, are used. The base of the photographic recording medium is primarily polyethyleneterephthalate or polypropylene.

The base used as a photographic recording medium should, first of all, be able to completely realize the color image to be transferred. Polyethyleneterephthalate is primarily used as the base for the recording medium and has better thermal stability, whiteness and smoothness than polypropylene. Unfortunately, polyethyleneterephthalate has a relatively small contact area with a recording ribbon by a heating head, and thus has insufficient dye transfer properties. As a result, printing stains are produced, thereby failing to obtain uniform image. This phenomenon is particularly serious in high speed printers. Generally, non-uniform image makes preservation of photograph against outer environment poor, which brings about many problems.

SUMMARY OF THE INVENTION

The present invention provides a thermal transfer recording medium having clear image quality, good preservation, and produces no printing stains or wrinkles.

According to an aspect of the present invention, a recording medium is provided for thermal transfer printers including: a base layer; a dye accepting layer applied to a surface of the base layer; and an inorganic material aid layer which is interposed between the base layer and the dye accepting layer and contains an organic binder resin, an inorganic material having a particle diameter of 10 μm or greater and a brightening agent.

The inorganic material may be at least one material selected from the group consisting of silica, alumina, calcium carbonate, kaolin, talc, calcium sulfate, barium sulfate, titanium oxide, zinc oxide, zinc carbonate, aluminum silicate, silicic acid, sodium silicate, magnesium silicate and calcium silicate.

The organic binder resin may be at least one material selected from the group consisting of polyvinyl alcohols, polyvinyl pyrrolidones, celluloses including methyl cellulose and hydroxyl propylmethyl cellulose, gelatin, polyethylene oxide, acrylics, polyesters, polyacrylate, polyvinyl acetate, polycarbonate, polyurethane, polyamide and polyvinyl chloride.

The content ratio of the inorganic material to the organic binder resin may be in the range of about 90:10 to 10:90, preferably in the range of about 70:30 to 30:70.

The inorganic material aid layer may have a thickness of about 0.5 to 10 μm.

The brightening agent may be at least one material selected from the group consisting of titanium dioxide, calcium carbonate, clay and zinc oxide.

The base layer may be a film or a synthetic paper made of at least one material selected from the group consisting of polyethyleneterephthalate, polyethylene, polypropylene, polyester and polyvinyl chloride.

The base layer may have a thickness of about 50 to 500 μm.

The dye accepting layer may include at least one material selected from the group consisting of polyester resin, polyacrylate resin, polyvinylacetate resin, polycarbonate resin, polyurethane resin, polyamide resin and polyvinyl chloride resin.

The dye accepting layer may further include at least one material selected from a fluorine-based compound, polyethylene wax and silicone oil.

The dye accepting layer may have a thickness of about 0.5 to 10 μm.

The base layer may include polyethyleneterephthalate or polypropylene, the dye accepting layer may include polyester resin or fluorine-based polymer, and the inorganic material aid layer may include an organic binder resin and silica.

The organic binder resin may be polyvinyl alcohol or polyester resin.

The dye accepting layer may include amino-modified silicone oil or vinyl chloride-vinyl acetate.

The recording medium for thermal transfer printers may further include an undercoating layer between the base layer and the inorganic material aid layer.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
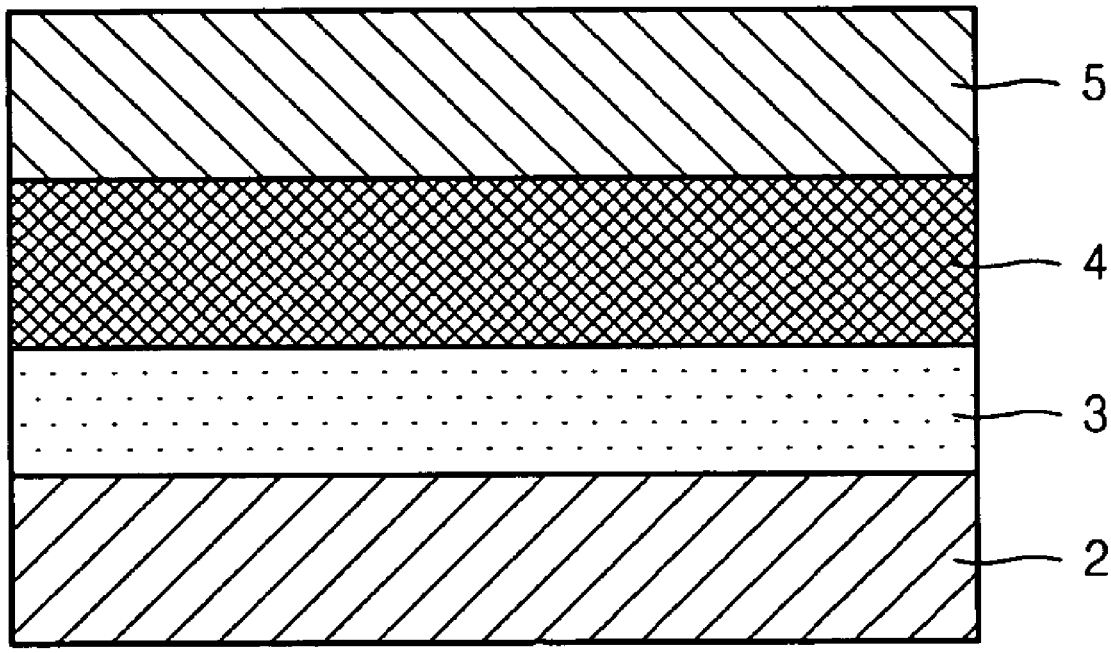
FIG. 1 is a cross-sectional view a recording medium for thermal transfer printers according to an embodiment of the present invention.

FIG. 1 is a cross-sectional view of a recording medium for thermal printers according to an embodiment of the present invention. The recording medium essentially includes a base layer 2, an inorganic material aid layer 4, and a dye accepting layer 5. The recording medium may further include an undercoating layer 3 between the inorganic material aid layer 4 and the base layer 2.

The inorganic material aid layer improves transfer of a recording ribbon dye to a recording medium to increase sensitivity of the recording medium. Improvement of the sensitivity is essentially required as the speed of thermal transfer printers increases. In particular, when a recording medium having good whiteness and thermal stability is based on a polyethyleneterephthalate film, the inorganic material aid layer becomes more important.

Transfer of a recording ribbon dye to a recording medium is generally improved by the use of a resin having a low glass transition temperature, Tg, in the dye accepting layer, by introducing additives such as inorganic materials or plasticizers into the dye accepting layer, or by the use of a polypropylene film which can increase the contact area between a recording ribbon and an accepting paper by an exothermic head. However, the resin having a low Tg reduces the stability and the inorganic materials deteriorate the smoothness and produce printing wrinkles and stains. When plasticizers are used, preservation and compatibility with the dye receiving resin are also insufficient.

A polypropylene-based recording material has reduced whiteness and is wrinkled in some recording ribbons during a printing process. Thus, there is a need for a solution other than the conventional methods. In various experiments, when an inorganic material aid layer containing granular materials is interposed between the base layer and the dye accepting layer, transfer of a recording ribbon dye to a recording medium is improved without printing wrinkles and without loss in preservation, thereby increasing the sensitivity of recording medium.

The inorganic material used in the inorganic material aid layer may be selected from the group consisting of silica, alumina, calcium carbonate, kaolin, talc, calcium sulfate, barium sulfate, titanium oxide, zinc oxide, zinc carbonate, aluminum silicate, silicic acid, sodium silicate, magnesium silicate and calcium silicate. Silica is preferred.

An inorganic material having a mean particle diameter of 10 μm or greater is most effective. When inorganic materials having a mean particle diameter less than 10 μm are used, the contact area between the recording ribbon and the dye accepting layer does not increase during operation of an exothermic head, and thus the desired effect cannot be obtained.

The inorganic material aid layer includes an organic binder resin together with the inorganic material. For water dispersible inorganic materials, polyvinyl alcohols, polyvinyl pyrrolidones, celluloses including methyl cellulose and hydroxyl propylmethyl cellulose, gelatin, polyethylene oxide, acrylic polymers and the like can be typically used. In addition, polymers such as polyesters and polyurethane or resins such as copolymers in the form of quaternary ammonium are suitable. Examples of a solvent type resin include polyesters resin, polyacrylate resin, polyvinyl acetate resin, polycarbonate resin, polyurethane resin, polyamide resin, and polyvinyl chloride resin used for the dye accepting layer, and a resin having a highly polar bonding.

The inorganic material may be used by dispersing in the organic binder resin. The ratio of the inorganic material to the organic binder resin may be in the range of about 90:10 to 10:90, preferably in the range of about 30:70 to 70:30. When the ratio of the inorganic material to the organic binder resin is less than 10:90, the desired effect cannot be obtained and when the ratio is greater than 90:10, coating adhesion is poor and printing wrinkles and stains are produced.

The inorganic material aid layer includes a brightening agent to increase the whiteness of the recording medium. Examples of the brightening agent include titanium dioxide, calcium carbonate, clay, zinc oxide, and the like. Introduction of the brightening agent into the inorganic material aid layer rather than the dye accepting layer can prevent the brightening agent from reducing the durability of image. Also, an antioxidant, a UV absorbent, a phenol-based additive, and the like, may further introduced into the inorganic material aid layer to improve light resistance.

The inorganic material aid layer may have a coating thickness of about 0.5 to 10 μm, preferably 1 to 5 μm. The inorganic material aid layer may be prepared using all coating methods and a bar or gravure coating method is generally used.

For a base of the thermal transfer recording medium, films such as polyestersulfone, polyimide, cellulose acetate, a copolymer of vinyl alcohol with acetal, or polyethyleneterephthalate, and synthetic papers made of polyethylene, polypropylene or polyesters may be used. When a polypropylene synthetic paper is used as the base, since the synthetic paper itself is easily deformed due to heat, simili interposed between two polypropylene synthetic papers may be used to ensure dimension stability.

The base layer may have a thickness of about 50 to 500 μm. In this case, handling is easy and bending is prevented when forming a coating layer thereon.

A material for the dye accepting layer should have affinity to a dye to be transferred from the thermal transfer recording ribbon, enable diffusion of dye to occur during a transferring process, and provide good preservation to dye after transfer of dye. Examples of such a material include polyester resin, polyacrylate resin, polyvinylacetate resin, polycarbonate resin, polyurethane resin, polyamide resin, polyvinyl chloride resin and resin having a highly polar bonding. In addition to these resins, the dye accepting layer may include fluorine-based compounds, polyethylene wax, silicone oil, and the like, to improve the release property during a transferring process and a surfactant for dispersion thereof.

In the dye accepting layer, titanium dioxide, calcium carbonate, clay, zinc oxide, and the like, may be included to increase whiteness and a fluorescent dye may be included to provide fluorescence. Also, an oxidant or an UV absorbent may be used to improve weather resistance.

The dye accepting layer may have a coating thickness of 0.5 to 10 μm after drying and the whole additives may be 0.1 to 20% with respect to resins.

For a solvent for a coating solution of the dye accepting layer, alcohol, glycol ether, ketone, toluene, dimethyl formaldehyde, ethyl acetate, and the like, may be used in consideration of solubility and workability, with ketone, toluene and dimethylformaldehye being preferred.

In addition, the recording medium according to an embodiment of the present invention may optionally include an undercoating layer between the base layer and the inorganic material aid layer to increase adhesion of these layers, as illustrated in FIG. 1. An UV blocking agent, an antioxidant, and the like, may be added to the undercoating layer solution to improve weakness of the base to light, thereby increasing light resistance of the recording medium. To increase whiteness of the recording medium, a brightening agent or a dye is generally added to the dye accepting layer, which causes yellowing of a printed part or unprinted part in a long term view point. By adding the brightening agent or dye to the undercoating layer rather than the dye accepting layer, the effect on outer environment can be reduced, and thus light resistance can be improved.

Examples of the resin useful for the undercoating layer include a polyol resin, polyurethane resin, acrylic resin and vinyl resin and a curing agent, such as polyisocyanates may be generally used in a combination. All of these resins may be used in films based on polyolefin such as polypropylene or polyethylene and polyethyeneterephthalate film.

The undercoating layer may have a thickness of about 0.1 to 5 μm, for example about 0.5 to 2 μm. The undercoating layer may be formed using all coating methods. A bar or gravure coating method is generally used.

The present invention will now be described in greater detail with reference to the following examples. The following examples are for illustrative purposes only and are not intended to limit the scope of the invention.

EXAMPLE 1

Polyethyleneterephthalate (thickness: 50 μm; SK, Korea) was deposited to both sides of simili paper (thickness: 100 μm; Hankuk Paper MFG Co., Ltd., Korea). Then, a coating material for an undercoating layer was applied to a surface of the polyethyleneterephthalate layer using a bar coater, and then was dried in an oven (100° C., 1 min) to obtain an undercoating layer having the composition as described below (thickness: about 1 μm).

| | |
|---|---|
| Polyol (DL-505SA-1, Shinsung Chemical Ind. Co. Ltd., Korea) | 90 parts by weight |
| Polyisocyanate (Shinsung Chemical Ind. Co. Ltd., Korea) | 10 parts by weight |

A coating material for an inorganic material aid layer was applied to the undercoating layer using a bar coater, and then was dried in an oven (110° C., 3 min) to obtain an inorganic material aid layer having the composition as described below (thickness: about 2 μm).

| | |
|---|---|
| Polyvinyl alcohol (P-17, DC Chemical Co., Ltd., Korea) | 10 parts by weight |
| Silica (ML362, 10 μm, DC Chemical Co., Ltd., Korea) | 9.5 parts by weight |
| Brightening agent (Tinopal-IJT, Ciba, Germany) | 0.5 part by weight |
| Water | 80 parts by weight |

A coating material for a dye accepting layer was applied to the inorganic material aid layer using a bar coater, and then was dried in an oven (110° C., 3 min) to obtain a dye accepting layer having the composition as described below (thickness: about 5 μm).

| | |
|---|---|
| Polyester resin (Vylon 200, Toyobo, Japan) | 19.9 parts by weight |
| Amino modified silicone oil (KF393, Shin-Etsu Chemical Co., Ltd., Japan) | 0.1 part by weight |
| Toluene | 40 parts by weight |
| Methylethylketone | 40 parts by weight |

-continued

EXAMPLE 2

A recording medium was prepared in the same manner as in Example 1, except that the composition of the inorganic material aid layer was as described below.

| | |
|---|---|
| Polyester resin (Vylon 200, Toyobo, Japan) | 10 parts by weight |
| Silica (ML363, 13 μm, DC Chemical Co., Ltd., Korea) | 9.5 parts by weight |
| Brightening agent (UBITEX-OB, Ciba, Germany) | 0.5 part by weight |
| Toluene | 40 parts by weight |
| Methylethylketone | 40 parts by weight |

EXAMPLE 3

A recording medium was prepared in the same manner as in Example 1, except that the composition of the inorganic material aid layer was as described below.

| | |
|---|---|
| Polyvinyl alcohol (P-17, DC Chemical Co., Ltd., Korea) | 9.5 parts by weight |
| Silica (ML362, 10 μm, DC Chemical Co., Ltd., Korea) | 9.5 parts by weight |
| Brightening agent (Tinopal-IJT, Ciba, Germany) | 0.5 part by weight |
| Phenol-based additive (Irganox 245DW, Ciba Chemical, France) | 0.5 parts by weight |
| Water | 80 parts by weight |

EXAMPLE 4

A recording medium was prepared in the same manner as in Example 2, except that the composition of the inorganic material aid layer was as described below.

| | |
|---|---|
| Polyester resin (Vylon 200, Toyobo, Japan) | 9.5 parts by weight |
| Silica (ML363, 13 μm, DC Chemical Co., Ltd., Korea) | 9.5 parts by weight |
| Brightening agent (UBITEX-OB, Ciba, Germany) | 0.5 part by weight |
| UV absorbent (Hisorb-P, LG Chemical, Korea) | 0.5 part by weight |
| Toluene | 40 parts by weight |
| Methylethylketone | 40 parts by weight |

EXAMPLE 5

A recording medium was prepared in the same manner as in Example 1, except that the composition of the dye accepting layer was as described below.

| | |
|---|---|
| Fluorine-based polymer (Kynar 500, Arkema Inc., France) | 10 parts by weight |
| Vinyl chloride-vinyl acetate (VYHD, Union Carbide, U.S.A.) | 10 parts by weight |
| Toluene | 40 parts by weight |
| Methylethylketone | 40 parts by weight |

EXAMPLE 6

A recording medium was prepared in the same manner as in Example 1, except that the undercoating layer was not formed.

COMPARATIVE EXAMPLE 1

A recording medium was prepared in the same manner as in Example 6, except that the inorganic material aid layer was not formed.

COMPARATIVE EXAMPLE 2

A recording medium was prepared in the same manner as in Example 1, except that the composition of the inorganic material aid layer was as described below.

| | |
|---|---|
| Polyvinyl alcohol (P-17, DC Chemical Co., Ltd., Korea) | 9.5 parts by weight |
| Silica (KS-1500, 7.0 μm, 21 Silica, Korea) | 9.5 parts by weight |
| Water | 80 parts by weight |

COMPARATIVE EXAMPLE 3

A recording medium was prepared in the same manner as in Example 1, except that the composition of the inorganic material aid layer was as described below.

| | |
|---|---|
| Polyvinyl alcohol (P-17, DC Chemical Co., Ltd., Korea) | 19 parts by weight |
| Silica (ML362, 10 μm, DC Chemical Co., Ltd., Korea) | 1 part by weight |
| Water | 80 parts by weight |

COMPARATIVE EXAMPLE 4

A recording medium was prepared in the same manner as in Example 1, except that the composition of the inorganic material aid layer was as described below.

| | |
|---|---|
| Polyvinyl alcohol (P-17, DC Chemical Co., Ltd., Korea) | 1 part by weight |
| Silica (ML362, 10 μm, DC Chemical Co., Ltd., Korea) | 19 part by weight |
| Water | 80 parts by weight |

COMPARATIVE EXAMPLE 5

A recording medium was prepared in the same manner as in Example 6, except that the inorganic material aid layer was not formed and the composition of the dye accepting layer was as described below.

| | |
|---|---|
| Polyester resin (Vylon 200, Toyobo, Japan) | 19.4 parts by weight |
| Amino modified silicone oil (KF393, Shin-Etsu Chemical Co., Ltd., Japan) | 0.1 part by weight |

-continued

| | |
|---|---|
| Brightening agent (UBITEX-OB, Ciba, Germany) | 0.5 part by weight |
| Toluene | 40 parts by weight |
| Methylethylketone | 40 parts by weight |

COMPARATIVE EXAMPLE 6

A recording medium was prepared in the same manner as in Comparative Example 5, except that the composition of the dye accepting layer was as described below.

| | |
|---|---|
| Polyester resin (Vylon 200, Toyobo, Japan) | 18.9 parts by weight |
| Amino modified silicone oil (KF393, Shin-Etsu Chemical Co., Ltd., Japan) | 0.1 part by weight |
| Brightening agent (UBITEX-OB, Ciba, Germany) | 0.5 part by weight |
| UV absorbent (Hisorb-P, LG Chemical, Korea) | 0.5 part by weight |
| Toluene | 40 parts by weight |
| Methylethylketone | 40 parts by weight |

COMPARATIVE EXAMPLE 7

A recording medium was prepared in the same manner as in Example 6, except that the inorganic material aid layer was not formed and the composition of the dye accepting layer was as described below.

| | |
|---|---|
| Fluorine-based polymer (Kynar 500, Arkema Inc., France) | 9.5 parts by weight |
| Vinyl chloride-vinyl acetate (VYHD, Union Carbide, U.S.A.) | 9.5 parts by weight |
| Brightening agent (UBITEX-OB, Ciba, Germany) | 0.5 part by weight |
| UV absorbent (Hisorb-P, LG Chemical, Korea) | 0.5 part by weight |
| Toluene | 40 parts by weight |
| Methylethylketone | 40 parts by weight |

Evaluation and Results

Sensitivity (Optical Density, Dmax), image wrinkle, and printing stain were evaluated on thermal transfer recording media prepared in Examples 1-6 and Comparative Examples 1-7. The results were listed in Table 1. Image printing was carried out using thermal transfer printers (PD 6000 available from Kodak, U.S.A. and SPP-2040 available from Samsung Electronics, Korea).

TABLE 1

| | Optical density, Dmax | | Image quality | |
|---|---|---|---|---|
| | Magenta | Black | Wrinkle | Stain |
| Example 1 | 2.15(2.09) | 2.21(2.32) | ○ | ○ |
| Example 2 | 2.17(2.07) | 2.22(2.31) | ○ | ○ |
| Example 3 | 2.14(2.10) | 2.21(2.30) | ○ | ○ |
| Example 4 | 2.17(2.10) | 2.19(2.27) | ○ | ○ |
| Example 5 | 2.16(2.11) | 2.20(2.28) | ○ | ○ |
| Example 6 | 2.11(2.08) | 2.15(2.22) | ○ | ○ |
| Comparative Example 1 | 1.91(1.75) | 1.95(2.03) | ○ | Δ |
| Comparative Example 2 | 1.95(1.74) | 1.94(2.04) | ○ | Δ |
| Comparative Example 3 | 1.92(2.06) | 1.98(2.06) | ○ | Δ |
| Comparative Example 4 | 2.15(1.74) | 2.16(2.27) | x | x |

TABLE 1-continued

| | Optical density, Dmax | | Image quality | |
|---|---|---|---|---|
| | Magenta | Black | Wrinkle | Stain |
| Comparative Example 5 | 1.93(1.73) | 1.96(2.01) | ○ | Δ |
| Comparative Example 6 | 1.94(1.73) | 1.97(2.03) | ○ | Δ |
| Comparative Example 7 | 1.95(1.77) | 1.95(2.02) | ○ | Δ |

* Optical density: Magenta and black images (1 cm × 1 cm) were printed, and then the optical density thereof was measured (SpectroEye, GretagMacbeth, U.S.A.).
* Wrinkle: Images were printed, and then presence and absence of wrinkles were confirmed by the naked eye and wrinkle sizes were compared (○: no wrinkle, Δ: wrinkle size <1 cm, X: wrinkle size ≧1 cm).
* Stain: Images were printed, and then presence and absence of stains were confirmed by the naked eye and the extent of stains was compared (○: no stain, Δ: some found, X: serious).

Whiteness and light resistance were evaluated on the thermal transfer recording media prepared in Examples 1-6 and Comparative Examples 1-7. The results are listed in Table 2. Image printing was carried out using a thermal transfer printer (SPP-2040, Samsung Electronics, Korea).

TABLE 2

| | | Light resistance | |
|---|---|---|---|
| | Whiteness | Magenta | Cyan |
| Example 1 | 101 | 96% | 93% |
| Example 2 | 103 | 95% | 94% |
| Example 3 | 103 | 98% | 95% |
| Example 4 | 104 | 96% | 94% |
| Example 5 | 105 | 97% | 95% |
| Example 6 | 103 | 96% | 95% |
| Comparative Example 1 | 92 | 97% | 95% |
| Comparative Example 2 | 93 | 97% | 94% |
| Comparative Example 3 | 93 | 96% | 93% |
| Comparative Example 4 | 93 | 96% | 94% |
| Comparative Example 5 | 106 | 85% | 82% |
| Comparative Example 6 | 105 | 90% | 87% |
| Comparative Example 7 | 104 | 92% | 89% |

* Whiteness: The surface of the dye accepting layer was measured with a whiteness meter (SpectroEye, GretagMacbeth, U.S.A.).
* Light resistance: Magenta and Cyan images (2 cm × 5 cm) were printed using the printer as described above and the optical density of the printed images was measured. The same images were exposed to light at 60° C. and for 20 hr (Q-Sun/3000 Xenon tester, Q-Lab, U.S.A.), and then the optical density of the exposed images was measured. The loss in optical density was calculated.

It can be seen from the results of Table 1 that when an inorganic material aid layer is interposed between a dye accepting layer and a base of a recording medium, transfer of a recording ribbon dye to the dye accepting layer was increased, thereby increasing the optical density, i.e., sensitivity, of the recording medium. However, when the particle size of the inorganic material is small or the content thereof is low (Comparative Examples 2 and 3), the desired effect is not obtained.

When the inorganic material aid layer is not formed, image stain is produced. Further, excessively high content of the inorganic material rather makes the image stain serious and produces wrinkles (Comparative Example 4). Thus, a proper amount of the inorganic material should be used.

Generally, the brightening agent increases the whiteness of the recording medium compared to when it is not used (Comparative Examples 1-4 in which no brightening agent was used). In the absence of additives such as an UV stabilizer, and the like, the light resistance of the recording medium is reduced (Comparative Example 5). When the brightening agent was used in the dye accepting layer and the inorganic material aid layer and the light resistance promoter was added to each brightening agent-containing layer, the light resistance is improved. The best effect was obtained when the brightening agent was added to the inorganic material aid layer (Comparative Examples 6 and 7). Thus, it can be seen that due to the brightening agent present in the intermediate layer rather than in the top layer and introduction of the inorganic material aid layer, image quality is generally improved and preservation against the outer environment becomes better.

The thermal transfer recording medium according to an embodiment of the present invention has the inorganic material aid layer interposed between the base and the dye accepting layer, which facilitates transfer of the recording ribbon dye. As a result, stain and wrinkle free and clear image quality can be obtained and light resistance can also be improved.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A recording medium for thermal transfer printers comprising:

a base layer;

a dye accepting layer applied to a surface of the base layer;

an inorganic material aid layer interposed between the base layer and the dye accepting layer, the inorganic material aid layer containing an organic binder resin, an inorganic material having a mean particle diameter of 10 μm or greater, and a brightening agent, and an undercoating layer between the base layer and the inorganic material aid layer, the undercoating layer including a dye, or a brightening agent, the undercoating layer selected from the group consisting of a polyol resin, polyurethane resin, acrylic resin and vinyl resin, and where the undercoat layer has a thickness of 0.1 to 5 μm;

wherein the inorganic material is silica, and the brightening agent is at least one material selected from the group consisting of titanium dioxide, calcium carbonate, clay, and zinc oxide, and the silica is present in a ratio to the organic binder of 90:10 to 10:90.

2. The recording medium for thermal transfer printers of claim 1, wherein the organic binder resin is selected from the group consisting of polyvinyl alcohols, polyvinyl pyrrolidones, celluloses including methyl cellulose and hydroxyl propylmethyl cellulose, gelatin, polyethylene oxide, acrylics, polyesters, polyacrylate, polyvinyl acetate, polycarbonate, polyurethane, polyamide, polyvinyl chloride, and mixtures thereof.

3. The recording medium for thermal transfer printers of claim 1, wherein the content ratio of the inorganic material to the organic binder resin is in the range of about 90:10 to 10:90.

4. The recording medium for thermal transfer printers of claim 1, wherein the content ratio of the inorganic material to the organic binder resin is in the range of about 70:30 to 30:70.

5. The recording medium for thermal transfer printers of claim 1, wherein the inorganic material aid layer has a thickness of about 0.5 to 10 μm.

6. The recording medium for thermal transfer printers of claim 1, wherein the base layer is a film or a synthetic paper made of at least one material selected from the group consisting of polyethylene, polypropylene, polyester and polyvinyl chloride.

7. The recording medium for thermal transfer printers of claim 1, wherein the base layer has a thickness of about 50 to 500 μm.

8. The recording medium for thermal transfer printers of claim 1, wherein the dye accepting layer comprises at least one material selected from the group consisting of polyester resin, polyacrylate resin, polyvinylacetate resin, polycarbonate resin, polyurethane resin, polyamide resin and polyvinyl chloride resin.

9. The recording medium for thermal transfer printers of claim 8, wherein the dye accepting layer further comprises at least one material selected from a fluorine-based compound, polyethylene wax and silicone oil.

10. The recording medium for thermal transfer printers of claim 1, wherein the dye accepting layer has a thickness of about 0.5 to 10 μm.

11. The recording medium for thermal transfer printers of claim 1, wherein the base layer comprises polyethyleneterephthalate or polypropylene, the dye accepting layer comprises polyester resin or fluorine-based polymer, and the inorganic material aid layer comprises an organic binder resin and silica.

12. The recording medium for thermal transfer printers of claim 11, wherein the organic binder resin is a polyvinyl alcohol or polyester resin.

13. The recording medium for thermal transfer printers of claim 11, wherein the dye accepting layer further comprises amino-modified silicone oil or vinyl chloride-vinyl acetate.

14. The recording medium of claim 1, wherein said undercoating layer further comprises a UV blocking agent or an antioxidant.

* * * * *